US011910837B2

(12) United States Patent
Wu

(10) Patent No.: US 11,910,837 B2
(45) **Date of Patent: *Feb. 27, 2024**

(54) VAPORIZER APPARATUS WITH CHILD RESISTANT DEVICE

(71) Applicant: Clear IP Corporation, Stafford, TX (US)

(72) Inventor: Jeff Wu, Stafford, TX (US)

(73) Assignee: Clear IP Corporation, Stafford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/858,351

(22) Filed: Jul. 6, 2022

(65) Prior Publication Data

US 2022/0330617 A1 Oct. 20, 2022

Related U.S. Application Data

(63) Continuation of application No. 17/097,986, filed on Nov. 13, 2020.

(60) Provisional application No. 62/936,136, filed on Nov. 15, 2019, provisional application No. 63/082,397, filed on Sep. 23, 2020.

(51) Int. Cl.

| | |
|---|---|
| ***A24F 13/00*** | (2006.01) |
| ***A24F 40/42*** | (2020.01) |
| ***A24F 40/49*** | (2020.01) |

(52) U.S. Cl.

CPC ..... *A24F 40/49* (2020.01); *A24F 40/42* (2020.01)

(58) Field of Classification Search

CPC ..... A24F 47/00

USPC ..... 131/328–329

See application file for complete search history.

(56) References Cited

U.S. PATENT DOCUMENTS

| | | | | |
|---|---|---|---|---|
| 10,414,560 | B1 | 9/2019 | Aryanpanah et al. | |
| 10,414,561 | B1 * | 9/2019 | Moghaddam | B65D 50/041 |
| 2016/0167845 | A1 * | 6/2016 | Harvey | B65D 50/041 220/23.91 |
| 2018/0037381 | A1 * | 2/2018 | White | B65D 81/02 |
| 2018/0140001 | A1 * | 5/2018 | Gabbay | A24B 15/167 |
| 2018/0271174 | A1 | 9/2018 | Qiu | |
| 2018/0296777 | A1 * | 10/2018 | Terry | A61M 15/0025 |
| 2019/0197225 | A1 * | 6/2019 | Khalifa | A24F 40/65 |
| 2020/0046030 | A1 * | 2/2020 | Krietzman | G06F 16/9035 |
| 2020/0138111 | A1 * | 5/2020 | Angelico | A24F 40/53 |

(Continued)

FOREIGN PATENT DOCUMENTS

WO 2019109004 A1 6/2019

*Primary Examiner* — Phuong K Dinh

(74) *Attorney, Agent, or Firm* — Polsinelli PC

(57) ABSTRACT

A vaporizer apparatus is provided. The vaporizer apparatus includes a cartridge body and a child resistant device. The cartridge body includes an activation button and an inhalation portion. The inhalation portion is operable to allow a user to draw vapor from the cartridge body. The child resistant device includes an outer cap and an inner cap nestled within an inside chamber of the outer cap. The inner cap is coupled with the cartridge body to prevent access to the inhalation of the cartridge body. In a locked configuration, the outer cap and the inner cap are disengaged such that the outer cap is freely movable independent of the inner cap. In an unlocking configuration, the outer cap and the inner cap are engaged with one another such that movement of the outer cap detaches the child resistant device from the cartridge body.

16 Claims, 4 Drawing Sheets

(56) References Cited

U.S. PATENT DOCUMENTS

| | | | | |
|---|---|---|---|---|
| 2020/0383380 | A1* | 12/2020 | Spencer | A24F 40/50 |
| 2021/0145065 | A1* | 5/2021 | Wu | B65D 50/041 |
| 2022/0386700 | A1* | 12/2022 | Krietzman | A24F 40/49 |

* cited by examiner

VAPORIZER APPARATUS WITH CHILD RESISTANT DEVICE

CROSS-REFERENCE TO RELATED APPLICATION

This application is a continuation of U.S. patent application Ser. No. 17/097,986, filed in the United States Patent and Trademark office on Nov. 13, 2021, which claims the benefit of U.S. Provisional Patent Application No. 62/936,136, filed in the U.S. Patent and Trademark Office on Nov. 15, 2019, and U.S. Provisional Patent Application No. 63/082,397, filed in the U.S. Patent and Trademark Office on Sep. 23, 2020, each of which is incorporated herein by reference in its entirety for all purposes.

FIELD

The present disclosure relates generally to child resistant devices. In at least one example, the present disclosure relates to cartridges vaporizers, vape-pens, and other devices that are designed to hold controlled substances while preventing access by children.

BACKGROUND

Controlled substances like hemp and related plant extracts are becoming legalized and introduced to the market. Apparatuses such as vaporizers are becoming more prevalent, which has led to the presence of vaporizers in many households, increasing the likelihood that they may be accessed by children.

BRIEF DESCRIPTION OF THE DRAWINGS

In order to describe a manner in which features of the disclosure can be obtained, reference is made to specific embodiments that are illustrated in the appended drawings. Based on an understanding that these drawings depict only example embodiments of the disclosure and are not intended to be limiting of scope, the principles herein are described and explained with additional specificity and detail through the use of the accompanying drawings in which.

DETAILED DESCRIPTION

Figure 1C:
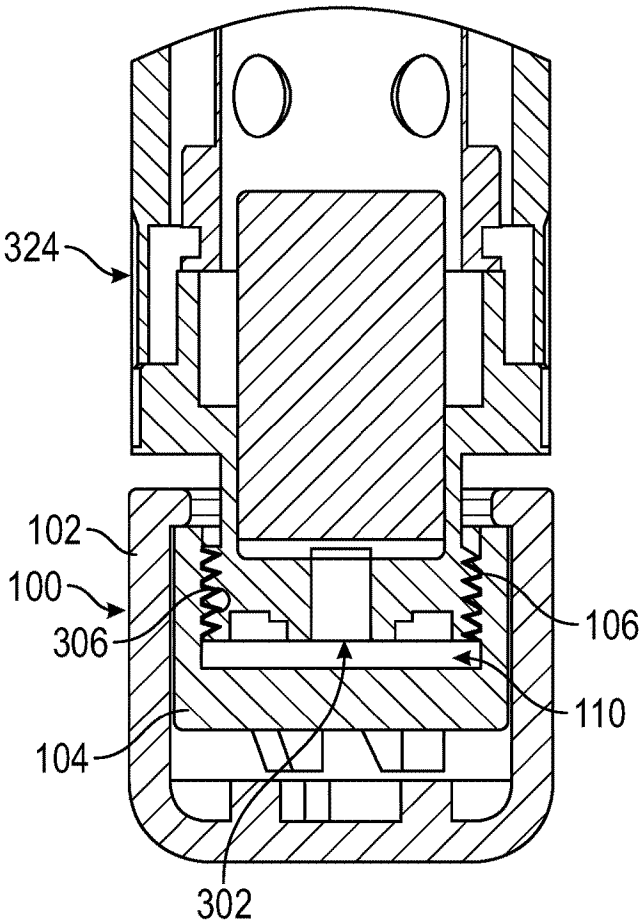
FIG. 1C illustrates an enlarged view of the apparatus of FIG. 1A.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the examples described herein. The drawings are not necessarily to scale and the proportions of certain parts may be exaggerated to better illustrate details and features of the present disclosure.

Conventional forms of child resistant packaging (CRP) are inadequate to service the growing vaporizer market. Current forms of CRP packaging like bags, boxes and tubes are difficult to automate in the industrial manufacturing process requiring multiple touchpoints from work crews. Moreover, current CRP packaging is not integrated into the apparatus.

The present disclosure provides a child resistant device for a vaporizer apparatus. The disclosed devices are particularly suited for use in vaporizer filling and manufacturing and allowing a wider array of packaging options for companies that fill vaporizers (i.e., cartridges, pens, etc.), thereby providing an integrated and low cost CRP option.

The child resistant packaging device can attach to a cartridge body and can only be removed by an adult wishing to access the vaporizer apparatus. The child resistant device can cover portions of the cartridge body to prevent use of the vaporizer apparatus. For example, the child resistant device can cover and/or prevent access to an inhalation portion to prevent drawing of vapor, a cartridge cap to prevent removal of the cartridge cap, a battery to prevent removal of the battery, and/or an activation button to prevent activation of the vaporizer apparatus.

The child resistant device can include an outer cap and an inner cap nestled within the outer cap. The inner cap can couple with the cartridge body. In a locked configuration, the outer cap and the inner cap are disengaged such that the outer cap is freely movable independent of the inner cap. Accordingly, an unwanted user can move the outer cap, and the outer cap freely moves independent of the inner cap so that the inner cap remains coupled with the cartridge body. In an unlocking configuration, the outer cap and the inner cap can be engaged with one another such that the movement of the outer cap detaches the child resistant device from the cartridge body. In the unlocking configuration, the outer cap and the inner cap are engaged such that movement of the outer cap translates to movement of the inner cap. For example, the outer cap and the inner cap can then move together as a single unit. The inner cap can then be moved, for example rotated, to be detached and removed from the cartridge body. The cartridge body is then accessible and the vaporizer apparatus can be used.

Figure 1B:
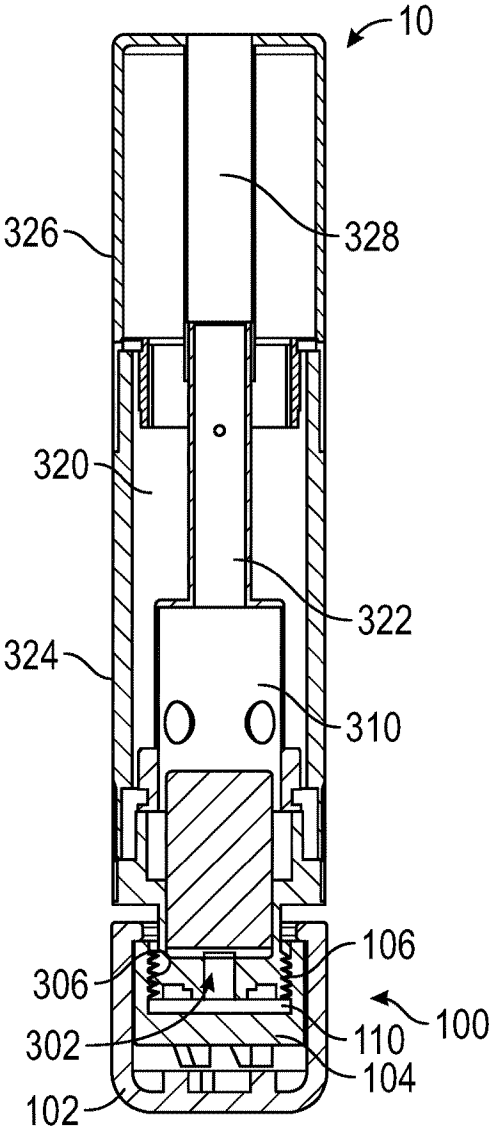
FIG. 1B illustrates a cross-sectional view of the apparatus of FIG. 1A.
Figure 1A:
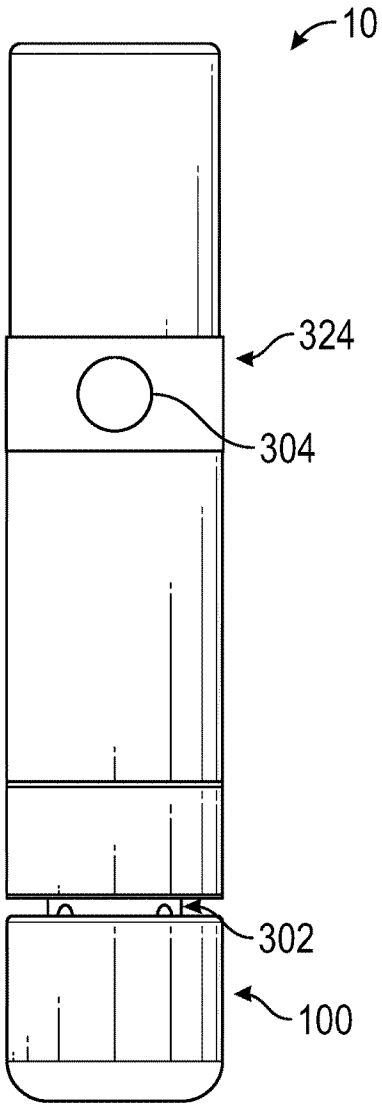
FIG. 1A illustrates an exemplary apparatus with child resistant device in accordance with the present disclosure.

FIGS. 1A-1C illustrate an example of a vaporizer apparatus 10 including a child resistant device 100 and a cartridge body 324. In at least one example, the vaporizer apparatus 10 can include a vaporizer pen.

The cartridge body 324 is operable to produce vapor to be inhaled by a user through an inhalation portion 302. An atomizer 322 is disposed in the cartridge body 324. The atomizer 322 generates the vapor by atomizing fluid 328 stored within a cartridge cap 326.

The cartridge cap 326 can be coupled with the cartridge body 324. In at least one example, the cartridge cap 326 can be removably coupled with the cartridge body 324 such that the cartridge cap 326 can be replaced when more fluid 328 is needed. For example, the cartridge cap 326 can be removably coupled with the cartridge body 324 by threaded engagement, one or more screws, hydraulic pressing, or any other suitable mechanism. In some examples, the cartridge cap 326 can be refilled with fluid 328 without removing the cartridge cap 326 from the cartridge body 324. In some examples, the cartridge cap 326 can be disposed within the cartridge body 324 such that the cartridge cap 326 is not removable. In at least one example, the cartridge cap 326 is located at an end of the cartridge body 324 opposite the inhalation portion 302.

The atomizer 322 is in fluid communication with a chamber 320 formed in the cartridge body 324 such that the vapor generated by the atomizer 322 is received and stored in the chamber 320. In at least one example, the atomizer 322 is disposed in the chamber 320. In at least one example, as illustrated in FIG. 1B, the atomizer 322 can be centrally located within the chamber 320.

In some embodiments, the vaporizer apparatus 10 can include a battery 310 for powering the atomizer 322. In at least one example, the battery 310 can be disposed in the cartridge body 324. In some examples, the housing for the battery 310 can form the cartridge body 324. In some examples, the battery 310 can be removably coupled with the cartridge body 324 to easily replace the battery 310 when needed. In at least one example, the battery 310 can be rechargeable. In some examples, the battery 310 can be single use. In some examples, the battery 310 can be connected to an outlet to provide power to the vaporizer apparatus 10.

As illustrated in FIG. 1A, the cartridge body 324 can include an activation button 304. In at least one example, the actuation button 304 can be located on the cartridge body 324 to provide easy access by the user. In some examples, the actuation button 304 can be located on the battery 310. In some examples, the actuation button 304 can be disposed on any portion of vaporizer apparatus 10 that is in communication with the battery 310. The activation button 304 can be actuated or depressed by the user to activate the atomizer 322 to generate vapor. The chamber 320 collects the vapor generated by the atomizer 322. The chamber 320 is in fluid communication with the inhalation portion 302 such that the vapor stored in the chamber 320 from the atomizer 322 can be drawn (for example, inhaled) by the user via the inhalation portion 302.

The vaporizer apparatus 10 includes a child resistant device 100. The child resistant device 100 is operable to be removably coupled with the cartridge body 324. In at least one example, the child resistant device 100, as illustrated in FIGS. 1B and 1C, is coupled with the cartridge body 324 by threaded engagement. The child resistant device 100 includes a threaded portion 106 which corresponds with a threaded portion 306 of the cartridge body 324. In some examples, the child resistant device 100 can be coupled with the cartridge body 324 by clamp, hydraulic press, or any other suitable mechanism that enables attachment to the cartridge body 324.

The child resistant device 100 and the cartridge body 324, when coupled together, prevent an unwanted user (for example, a child, etc.) from using the vaporizer apparatus 10 by preventing access to the inhalation portion 302. Accordingly, the unwanted user cannot draw the vapor from the vaporizer apparatus 10 without removal of the child resistant device 100. The child resistant device 100 is configured such that the child resistant device 100 cannot be detached from the cartridge body 324 without being in a specific unlocking configuration. To transition the child resistant device 100 into the unlocking configuration can be difficult for the unwanted user such as a child to prevent easy access to the vaporizer apparatus 10.

FIGS. 2A-2G illustrate an example of a child resistant device 100. In at least one example, the diameter of the child resistant device 100 can be about 1 centimeter. In some examples, the diameter of the child resistant device 100 can range from about 0.5 centimeters to about 2 centimeters. The diameter of the child resistant device 100 can vary, so long as the child resistant device 100 prevents use of the vaporizer apparatus 10 such as covering and preventing access to the inhalation portion 302 of the cartridge body 324.

As shown in FIGS. 2A-2G, the child resistant device 100 can include an outer cap 102 and an inner cap 104 nested within the outer cap 102. The outer cap 102 and the inner cap 104 can be coaxial. In at least one example, the outer cap 102 forms an inside chamber 114 which receives the inner cap 104. The inner cap 104 is sized and shaped so that the inner cap 104 is disposed within and nested within the inside chamber 114 of the outer cap 102. The inner cap 104 can form a receiving portion 110 operable to receive at least a portion of the cartridge body 324, for example the inhalation portion 302.

Figure 2A:
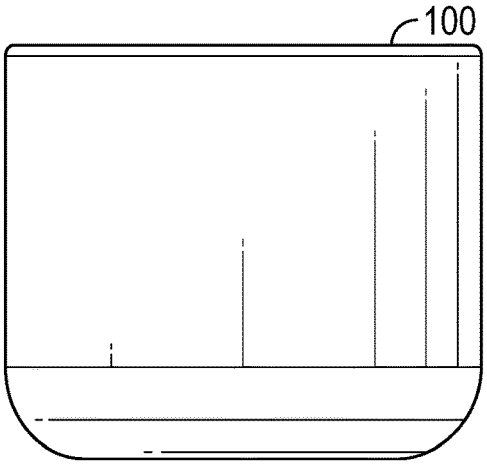
FIG. 2A illustrates a child resistant device in accordance with the present disclosure.
Figure 2B:
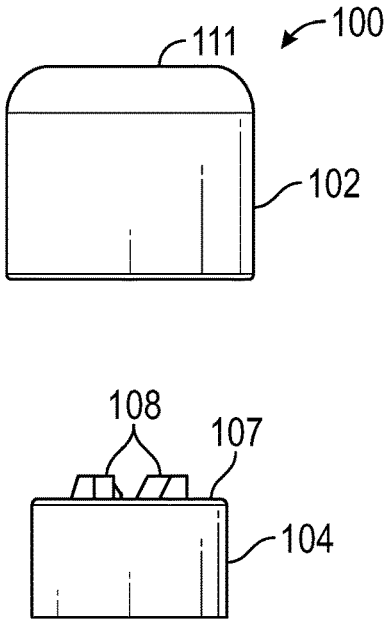
FIG. 2B illustrates an exploded view of the child resistant device of FIG. 2A.
Figure 2C:
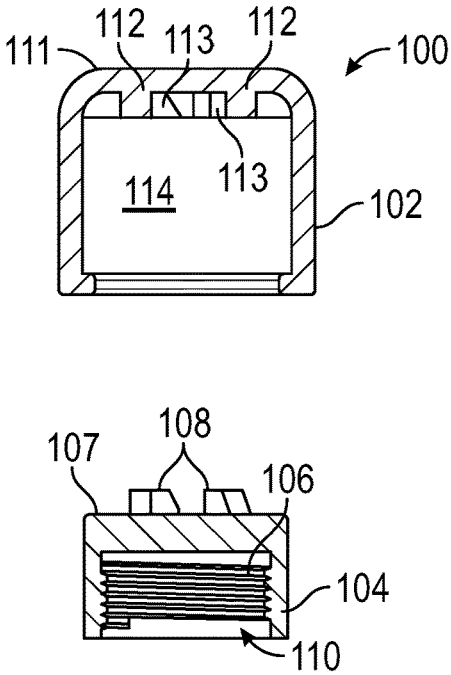
FIG. 2C illustrates an exploded, cross-sectional view of the child resistant device of FIG. 2A.
Figure 2D:
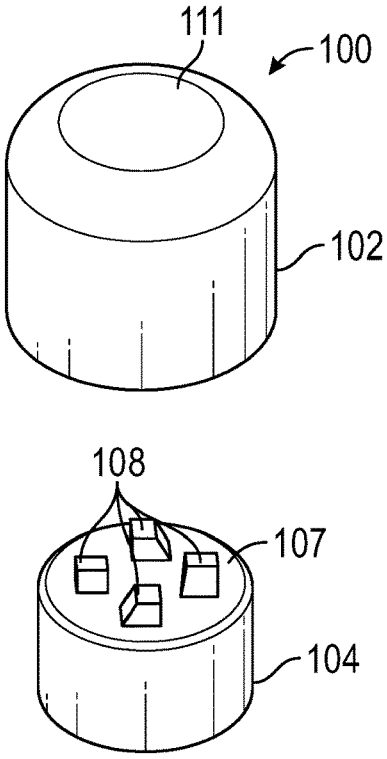
FIG. 2D illustrates an exploded, top perspective view of the child resistant device of FIG. 2A.
Figure 2E:
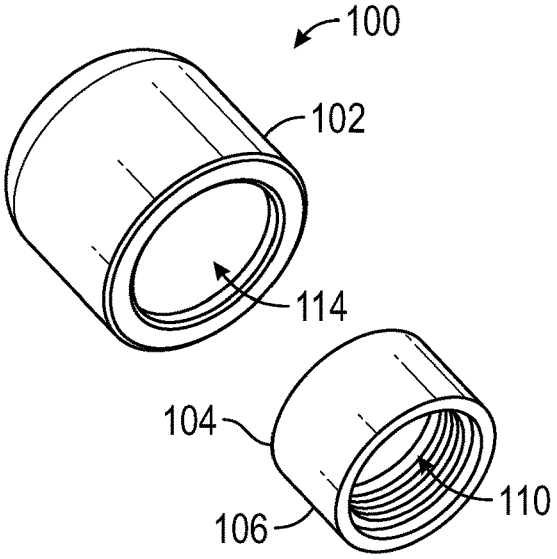
FIG. 2E illustrates an exploded, bottom perspective view of the child resistant device of FIG. 2A.
Figure 2F:
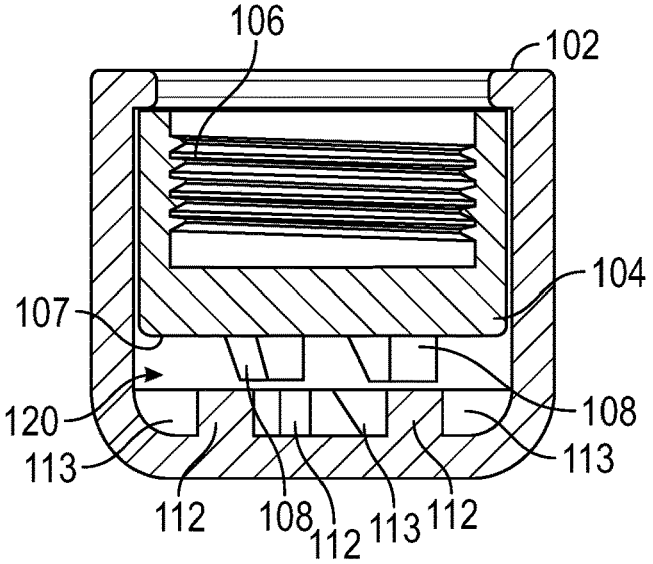
FIG. 2F illustrates a cross-sectional view of the child resistant device of FIG. 2A.
Figure 2G:
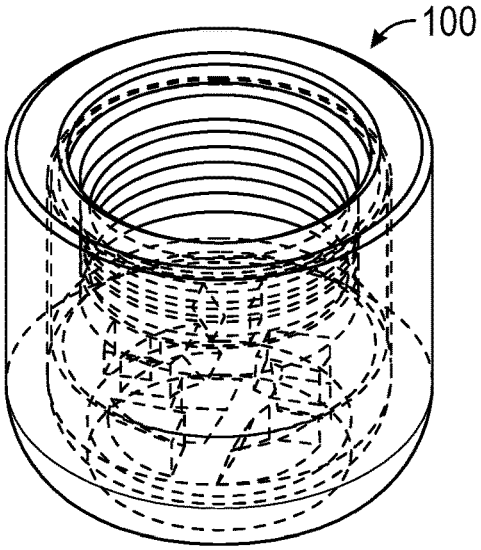
FIG. 2G illustrates a perspective transparent view of the child resistant device of FIG. 2A.
Figure 3A:
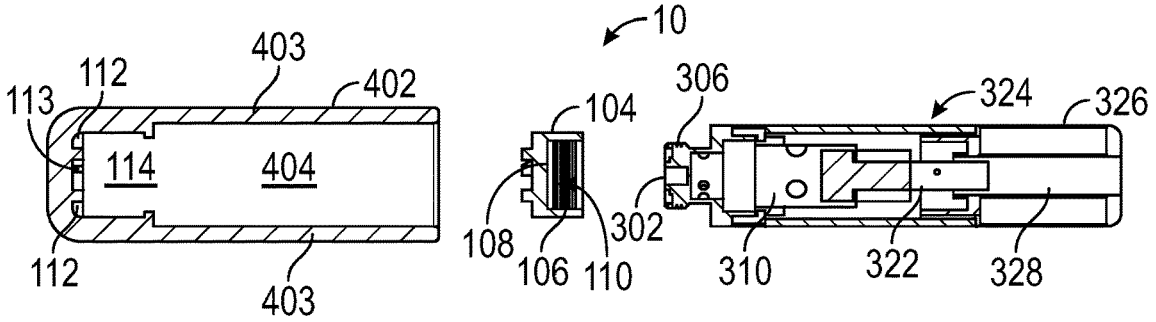
FIG. 3A illustrates an exploded, cross-sectional view of an apparatus with another example of a child resistant device in accordance with the present disclosure.
Figure 3B:
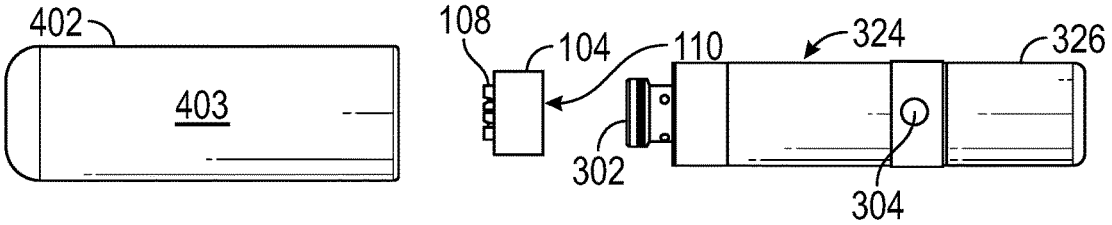
FIG. 3B illustrates an exploded, side view of the apparatus of FIG. 3A.
Figure 3C:
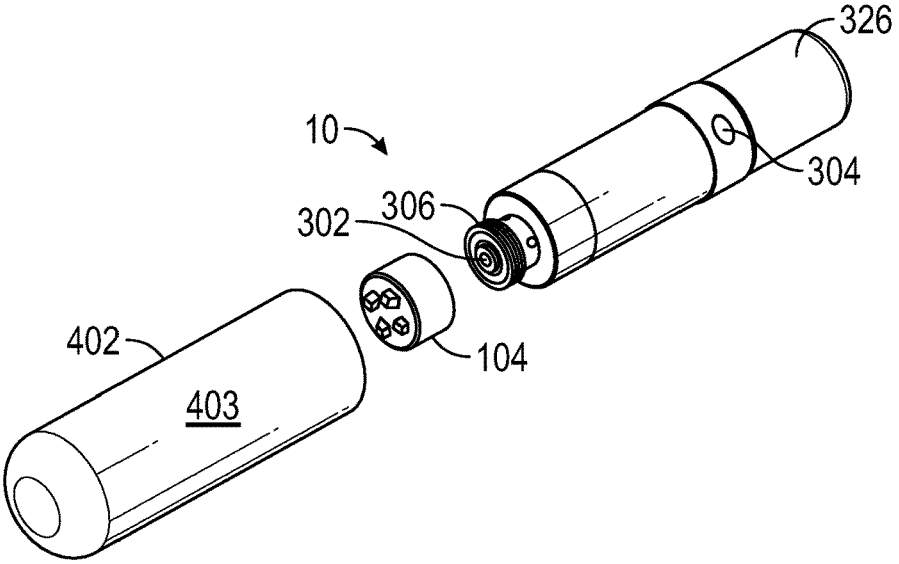
FIG. 3C illustrates an exploded, perspective view of the apparatus of FIG. 3A.
Figure 3D:
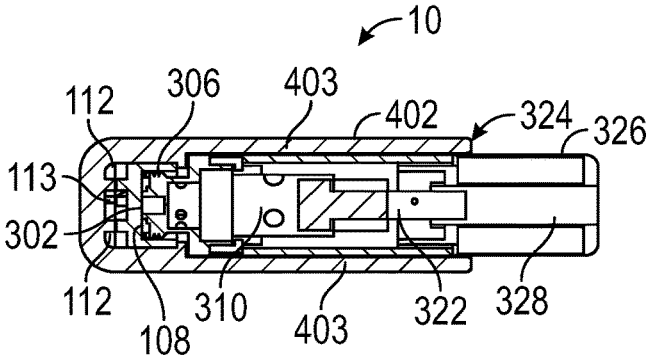
FIG. 3D illustrates an assembled view of the apparatus of FIG. 3A.

When in a locked configuration, for example as shown in FIGS. 2F and 2G, the outer cap 102 and the inner cap 104 are disengaged such that the outer cap 102 is freely movable independent of the inner cap 104. Accordingly, rotation or movement of the outer cap 102 does not translate to the inner cap 104, and the inner cap 104 does not detach from cartridge body 324. For example, as illustrated, the child resistant device 100 can be coupled with the cartridge body 324 by threaded engagement, and rotation of the inner cap 104 can detach the child resistant device 100 from the cartridge body 324. However, in the locked configuration, as the outer cap 102 is freely movably independent of the inner cap 104, rotation of the outer cap 102 does not translate to rotation of the inner cap 104. Accordingly, the child resistant device 100 remains coupled to the cartridge body 324 to prevent access to the vaporizer apparatus 10.

When in an unlocking configuration, the outer cap 102 and the inner cap 104 can be engaged with one another such that movement of the outer cap 102 detaches the child resistant device 100 from the cartridge body 324. In the unlocking configuration, the movement of the outer cap 102 can be translated to the inner cap 104 such that the inner cap 104 also moves to allow the inner cap 104 to detach from the cartridge body 324.

As illustrated in FIGS. 2A-2G, the inner cap 104 can include one or more teeth 108 projecting outwardly from a surface 107 of the inner cap 104. In at least one example, the teeth 108 can extend out of the top surface 107 of the inner cap 104. In other examples, the teeth 108 can project from a side surface of the inner cap 104. In some examples, the teeth 108 can be centrally disposed a distance away from the radial edges of the surface 107 of the inner cap 104. In some examples, the teeth 108 can be arranged in a concentric pattern or any other suitable pattern.

The outer cap 102 can include outer cap ridges 112 projecting downward from a top surface 111 of the outer cap 102 and into the inside chamber 114 of the outer cap 102. The outer cap ridges 112 can project into a void 120 formed between the inner cap 104 and the outer cap 102, for example as illustrated in FIG. 2F. The outer cap ridges 112 form one or more gaps 113 between the outer cap ridges 112. The one or more gaps 113 correspond with and are operable to receive the teeth 108 of the inner cap 104 when the void 120 between the outer cap 102 and the inner cap 104 is at least partially closed. A sufficient force can compress the outer cap 102 towards the inner cap 104 to at least partially close void 120, engaging the outer cap 102 and the inner cap 104, such that the teeth 108 are at least partially received in the gaps 113. Upon compression of the outer cap 102 towards the inner cap 104, the child resistant device 100 transitions from the locked configuration to the unlocking configuration. When the teeth 108 are at least partially received in the gaps 113 such that the child resistant device 100 is in the unlocking configuration, upon movement such as rotation of the outer cap 102, the outer cap ridges 112 abut the teeth 108 of the inner cap 104 to correspondingly move or rotate the inner cap 104. The teeth 108 can be arranged so that, when engaged with outer cap ridges 112, both the inner cap 104 and outer cap 102 may be coaxially rotated as a single unit in similar fashion to a twist cap, etc.

While the disclosure discusses the teeth 108 being disposed on the inner cap 104 and the outer cap ridges 112 and corresponding gaps 113 being disposed on the outer cap 102, the opposing arrangement may be applicable. In such a case, the outer cap 102 may include the teeth 108, and the ridges 112 and corresponding gaps 113 are formed on the inner cap 104, so long as the outer cap 102 and the inner cap 104 become engaged upon a compression force. Other suitable mechanisms to engage the outer cap 102 and the inner cap 104 can be utilized without deviating from the scope of the present disclosure.

Once the child resistant device 100 has coupled with the cartridge body 324, the child resistant device 100 may remain securely in place upon the cartridge body 324 until such a time that a user transitions the child resistant device 100 from the lock configuration to the unlocking configuration by pressing the top external surface of the outer cap 102 "down", or towards, the inner cap 104. The user can then detach the child resistant device 100 from the cartridge body 324, for example by rotating and unscrewing the child resistant device 100 off of the cartridge body 324. When the top external surface of the outer cap 102 is not pressed down, and thus outer cap ridges 112 and teeth 108 are not engaged, the child resistant device 100 remains in the locked configuration and the outer cap 102 may rotate freely around the inner cap 104 without causing the inner cap 104 to rotate in tandem or be unscrewed off the cartridge body 324. In at least one example, during manufacture of the vaporizer apparatus 10, the child resistant device 100 can be manufactured and installed automatically during assembly.

FIGS. 3A-3D illustrate an example of a child resistant device 100 which is of longer length to cover a more portions of the vaporizer apparatus 10. As discussed above, the outer cap 402 forms the inside chamber 114 in which the inner cap 104 is disposed. The inner cap 104 forms the receiving portion 110 which is operable to receive at least the inhalation portion 302 of the cartridge body 324 to prevent access to the inhalation portion 302. As illustrated in FIGS. 3A-3D, the outer cap 402 can include extension walls 403 which extend from portion of the cap 402 forming the inside chamber 114. The extension walls 403 can form an extended chamber 404 which is operable to receive at least a portion of the cartridge body 324 to prevent access to additional components of the vaporizer apparatus 10. When the cartridge body 324 is received by the extended chamber 404, the extension walls 403 can longitudinally extend and cover portions of the vaporizer apparatus 10. In some examples, the outer cap 402 can extend over at least a portion of the cartridge body 324 such that the outer cap 402 covers the activation button 304, preventing access to the activation button 304. In some examples, the outer cap 402 can extend over at least a portion of the cartridge cap 326, preventing undesired removal of the cartridge cap 326. For example, the outer cap 402 can prevent a user from obtaining a hand hold of the cartridge cap 326 so that the user cannot detach the cartridge cap 326 from the cartridge body 324. In some examples, the outer cap 402 can extend over the at least a portion of the cartridge body 324 to prevent access to the battery 310. Accordingly, the unwanted user cannot remove the battery 310. As a result, additional mechanisms of vaporizer apparatus 10, such as the battery 310, the cartridge cap 326, and/or the activation button 304, can be shielded against manipulation by, for example, children while the cartridge body 324 is sheathed within the cap 402, thereby providing yet further increased security.

The disclosures shown and described above are only examples. Even though numerous properties and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

The invention claimed is:

1. A vaporizer apparatus comprising:

a body having an inhalation portion, the inhalation portion operable to allow a user to draw vapor from the body;

a child resistant device including an outer cap and an inner cap nestled within an inside chamber of the outer cap, the inner cap being coupled with the body to prevent access to the inhalation portion of the body; and a cartridge cap coupled with the body, wherein the outer cap extends over the body and over at least a portion of the cartridge cap, preventing removal of the cartridge cap, wherein in a locked configuration of the child resistant device, the outer cap and the inner cap are disengaged such that the outer cap is freely movable independent of the inner cap, wherein in an unlocking configuration of the child resistant device, the outer cap and the inner cap are engaged with one another such that movement of the outer cap detaches the child resistant device from the body.

2. The vaporizer apparatus of claim 1, wherein the outer cap extends over at least a portion of the body such that the outer cap covers an activation button, preventing access to the activation button.

3. The vaporizer apparatus of claim 1, wherein the inner cap and the body are coupled by threaded engagement.

4. The vaporizer apparatus of claim 1, wherein the inner cap includes one or more teeth projecting outwardly from a transverse surface of the inner cap, wherein the outer cap includes outer cap ridges which form one or more gaps operable to receive the one or more teeth of the inner cap.

5. The vaporizer apparatus of claim 4, wherein in the unlocking configuration, the outer cap and the inner cap are engaged by the one or more teeth being received in the one or more gaps such that upon rotation of the outer cap, the outer cap ridges abut the one or more teeth of the inner cap to rotate the inner cap.

6. The vaporizer apparatus of claim 1, wherein upon compression of the outer cap towards the inner cap, the child resistant device transitions from the locked configuration to the unlocking configuration.

7. The vaporizer apparatus of claim 1, further comprising an atomizer in fluid communication from the cartridge cap, the atomizer operable to atomize fluid in the cartridge cap into the vapor.

8. The vaporizer apparatus of claim 7, wherein the atomizer is operable to be activated by the activation button.

9. The vaporizer apparatus of claim 7, wherein the body forms a chamber in fluid communication with the inhalation portion, the vapor from the atomizer being stored in the chamber.

10. The vaporizer apparatus of claim 1, further comprising a battery, wherein the outer cap extending over the at least a portion of the body prevents access to the battery.

11. A child resistant device comprising:

an outer cap;

an inner cap nestled within an inside chamber of the outer cap, the inner cap being coupled with an apparatus to prevent access to the apparatus; and a cartridge cap coupled with a body, wherein the outer cap extends over the body and over at least a portion of the cartridge cap, preventing removal of the cartridge cap, wherein in a locked configuration, the outer cap and the inner cap are disengaged such that the outer cap is freely movable independent of the inner cap, wherein in an unlocking configuration, the outer cap and the inner cap are engaged with one another such that movement of the outer cap detaches the child resistant device from the apparatus.

12. The child resistant device of claim 11, wherein the outer cap extends over at least a portion of the body such that the outer cap covers an activation button, preventing access to the activation button.

13. The child resistant device of claim 11, wherein the inner cap and the body of the device are coupled by threaded engagement.

14. The child resistant device of claim 11, wherein the inner cap includes one or more teeth projecting outwardly from a transverse surface of the inner cap, wherein the outer cap includes outer cap ridges which form one or more gaps operable to receive the one or more teeth of the inner cap.

15. The child resistant device of claim 14, wherein in the unlocking configuration, the outer cap and the inner cap are engaged by the one or more teeth being received in the one or more gaps such that upon rotation of the outer cap, the outer cap ridges abut the one or more teeth of the inner cap to rotate the inner cap.

16. The child resistant device of claim 11, wherein upon compression of the outer cap towards the inner cap, the child resistant device transitions from the locked configuration to the unlocking configuration.

* * * * *